US012371294B2

(12) United States Patent
Daigo et al.

(10) Patent No.: US 12,371,294 B2
(45) Date of Patent: Jul. 29, 2025

(54) SHEET DISCHARGE DEVICE AND SHEET POST-PROCESSING DEVICE INCLUDING THE SAME

(71) Applicant: KYOCERA Document Solutions Inc., Osaka (JP)

(72) Inventors: Hironori Daigo, Osaka (JP); Shuji Osaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 292 days.

(21) Appl. No.: 18/348,712

(22) Filed: Jul. 7, 2023

(65) Prior Publication Data

US 2024/0017954 A1 Jan. 18, 2024

(30) Foreign Application Priority Data

Jul. 13, 2022 (JP) ..... 2022-112348

(51) Int. Cl.

| | |
|---|---|
| ***B65H 31/34*** | (2006.01) |
| ***B65H 31/02*** | (2006.01) |
| ***B65H 31/20*** | (2006.01) |
| *B65H 43/08* | (2006.01) |

(52) U.S. Cl.

CPC ..... *B65H 31/34* (2013.01); *B65H 31/02* (2013.01); *B65H 31/20* (2013.01); *B65H 43/08* (2013.01); *B65H 2301/161* (2013.01); *B65H 2301/332* (2013.01); *B65H 2301/36112* (2013.01); *B65H 2801/06* (2013.01)

(58) Field of Classification Search

CPC ..... B65H 31/10; B65H 31/34; B65H 31/38

See application file for complete search history.

(56) References Cited

U.S. PATENT DOCUMENTS

| | | | | |
|---|---|---|---|---|
| 7,300,052 | B2 * | 11/2007 | Tamura | B65H 31/34 271/220 |
| 8,256,766 | B2 * | 9/2012 | Iwata | B65H 33/08 271/223 |
| 8,387,974 | B2 * | 3/2013 | Hayashi | B65H 33/08 271/220 |
| 8,695,971 | B2 * | 4/2014 | Sekiyama | B65H 31/24 271/189 |

(Continued)

FOREIGN PATENT DOCUMENTS

JP 2008-308243 A 12/2008

*Primary Examiner* — Howard J Sanders
(74) *Attorney, Agent, or Firm* — Stein IP LLC

(57) ABSTRACT

A sheet discharge device includes a discharge portion, a sheet stacking tray, a pair of alignment members and a pair of width regulation members, a shift portion, and a control portion. The pair of alignment members include an arm portion formed of a rigid body, and an alignment portion formed of a flat-shaped elastic material and fixed to a swingable end of the arm portion. In the sorting processing, when stacking a sheet at a first position, the control portion causes a first alignment member to ride on a top surface of the sheet and a first side edge of a second alignment member to make contact with the sheet, and, when stacking the sheet at a second position, causes the second alignment member to ride on the top surface of the sheet and the first side edge of the first alignment member to make contact with the sheet.

9 Claims, 7 Drawing Sheets

(56) References Cited

U.S. PATENT DOCUMENTS

| | | | | |
|---|---|---|---|---|
| 11,618,645 | B2 * | 4/2023 | Yoneyama | B65H 5/062 271/240 |
| 2009/0236798 | A1 | 9/2009 | Kimura et al. | 271/221 |
| 2012/0299238 | A1 | 11/2012 | Kimura et al. | 271/221 |

* cited by examiner

SHEET DISCHARGE DEVICE AND SHEET POST-PROCESSING DEVICE INCLUDING THE SAME

INCORPORATION BY REFERENCE

This application is based on and claims the benefit of priority from Japanese Patent Application No. 2022-112348 filed on Jul. 13, 2022, the contents of which are hereby incorporated by reference.

BACKGROUND

The present disclosure relates to a sheet discharge device that discharges a sheet having an image formed thereon by an image forming apparatus, such as a copier or a printer, or a sheet having been subjected to predetermined post-processing by a sheet post-processing device, and also relates to a sheet post-processing device including such a sheet discharge device.

Conventionally, there has been used a sheet post-processing device that is capable of executing post-processing such as stapling processing of stacking together a plurality of sheets (paper sheets) having images formed thereon by an image forming apparatus such as a copier or a printer into a sheet bundle and binding the sheet bundle with a staple, punch-hole forming processing of forming a punch hole (perforation) in the sheet with a punch hole forming device, and folding processing of folding a sheet into two or three.

Such a sheet post-processing device is provided with a sheet discharge device that includes a pair of discharge rollers that discharge post-processed sheets and a sheet stacking tray that receives sheets discharged by the pair of discharge rollers to be stacked thereon. There is also known a sheet discharge device that includes an alignment member for aligning a sheet stacked on the sheet stacking tray.

SUMMARY

According to one aspect of the present disclosure, a sheet discharge device includes a discharge portion, a sheet stacking tray, an alignment mechanism including a pair of alignment members and a pair of width regulation members, a shift portion, and a control portion. The discharge portion discharges a sheet through a sheet discharge port. On the sheet stacking tray, a sheet discharged through the sheet discharge port is stacked. The pair of alignment members are disposed on opposite sides in a sheet width direction orthogonal to a discharge direction of the sheet, and make contact with a top surface of the sheet stacked at a reference position on a sheet stacking surface of the sheet stacking tray. The pair of width regulation members are disposed outward of the alignment members with respect to the sheet width direction, and are reciprocatable in the sheet width direction. The shift portion, when the discharge portion discharges a plurality of copies of a bundle of the sheet, shifts a stacking position of the sheet stacked on the sheet stacking tray alternately on a copy-by-copy basis to a first position that is on one side and a second position that is on an other side with respect to the reference position in the sheet width direction. The control portion controls the shift portion, the discharge portion, and the alignment mechanism. The pair of alignment members include an arm portion and an alignment portion. The arm portion is formed of a rigid body, and is supported at an upper part of the sheet discharge port so as to be vertically swingable. The alignment portion is fixed to a swingable end of the arm portion and makes contact with a side edge of the sheet in the sheet width direction. The alignment portion is formed of a flat-shaped elastic material extending in the sheet width direction, and has a first side edge which is such one of a pair of opposite side edges thereof in the sheet width direction as is located inward of an other one of the pair of opposite side edges thereof in the sheet width direction. The first side edge is inclined from an inner side to an outer side in the sheet width direction toward a downstream side in the discharge direction. The control portion is capable of executing sorting processing in which the bundle of the sheet is sorted by alternately shifting, on the copy-by-copy basis, between the first position and the second position by means of the shift portion. In the sorting processing, when stacking the sheet at the first position, the control portion causes a first alignment member of the pair of alignment members that is disposed on the one side to ride on a top surface of the sheet and causes the first side edge of a second alignment member disposed on the other side to make contact with a side edge of the sheet on the other side to align the sheet at the first position, and, when stacking the sheet at the second position, the control portion causes the second alignment member to ride on the top surface of the sheet and causes the first side edge of the first alignment member to make contact with a side edge of the sheet on the one side to align the sheet at the second position.

DETAILED DESCRIPTION

Hereinafter, embodiments of the present disclosure will be described with reference to the accompanying drawings.

Figure 1:
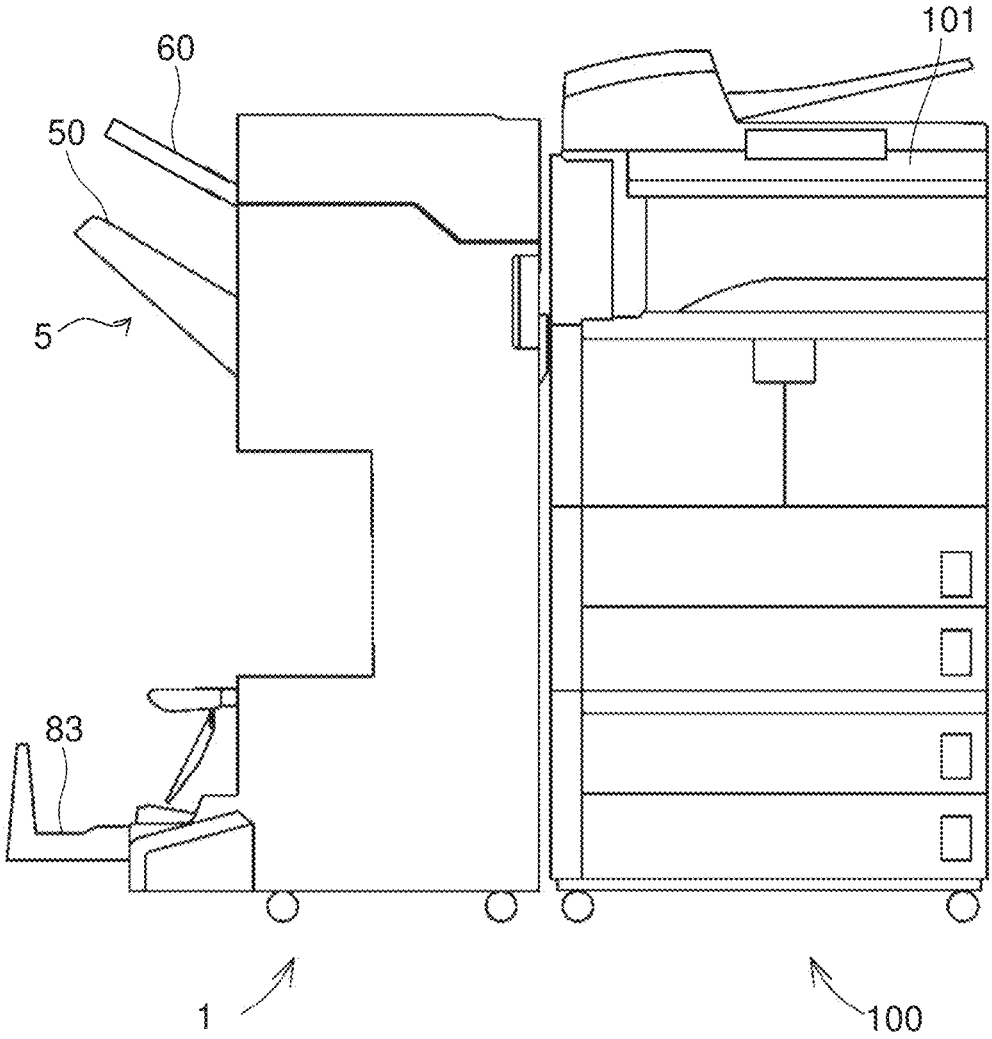
FIG. 1 is a schematic diagram showing a configuration of an image forming system composed of a sheet post-processing device including a first sheet discharge portion as an example of a sheet discharge device of the present disclosure and an image forming apparatus to which the sheet post-processing device is coupled.

FIG. 1 is a schematic diagram showing a configuration of an image forming system composed of a sheet post-processing device 1 including a first sheet discharge portion 5 as an example of a sheet discharge device of the present disclosure and an image forming apparatus 100 to which the sheet post-processing device 1 is coupled.

As shown in FIG. 1, the image forming apparatus 100 prints an image on a sheet based on image data externally inputted via an unillustrated network communication portion or image data read by an image reading portion 101 disposed in an upper part of the image forming apparatus 100.

The sheet post-processing device 1 is detachably coupled to a side face of the image forming apparatus 100. The sheet post-processing device 1 performs post processing, such as punch hole forming processing, stapling processing, folding processing, etc., with respect to a sheet having undergone image formation (printing) performed by the image forming apparatus 100. Note that the sheet post-processing device 1 is not limited to one that performs post processing with respect to a sheet having been automatically conveyed from the image forming apparatus 100, but may be one that by itself conveys a sheet having been set by a user in an unillustrated tray to a position at which post processing can be performed, and then performs post processing with respect to the sheet.

Figure 2:
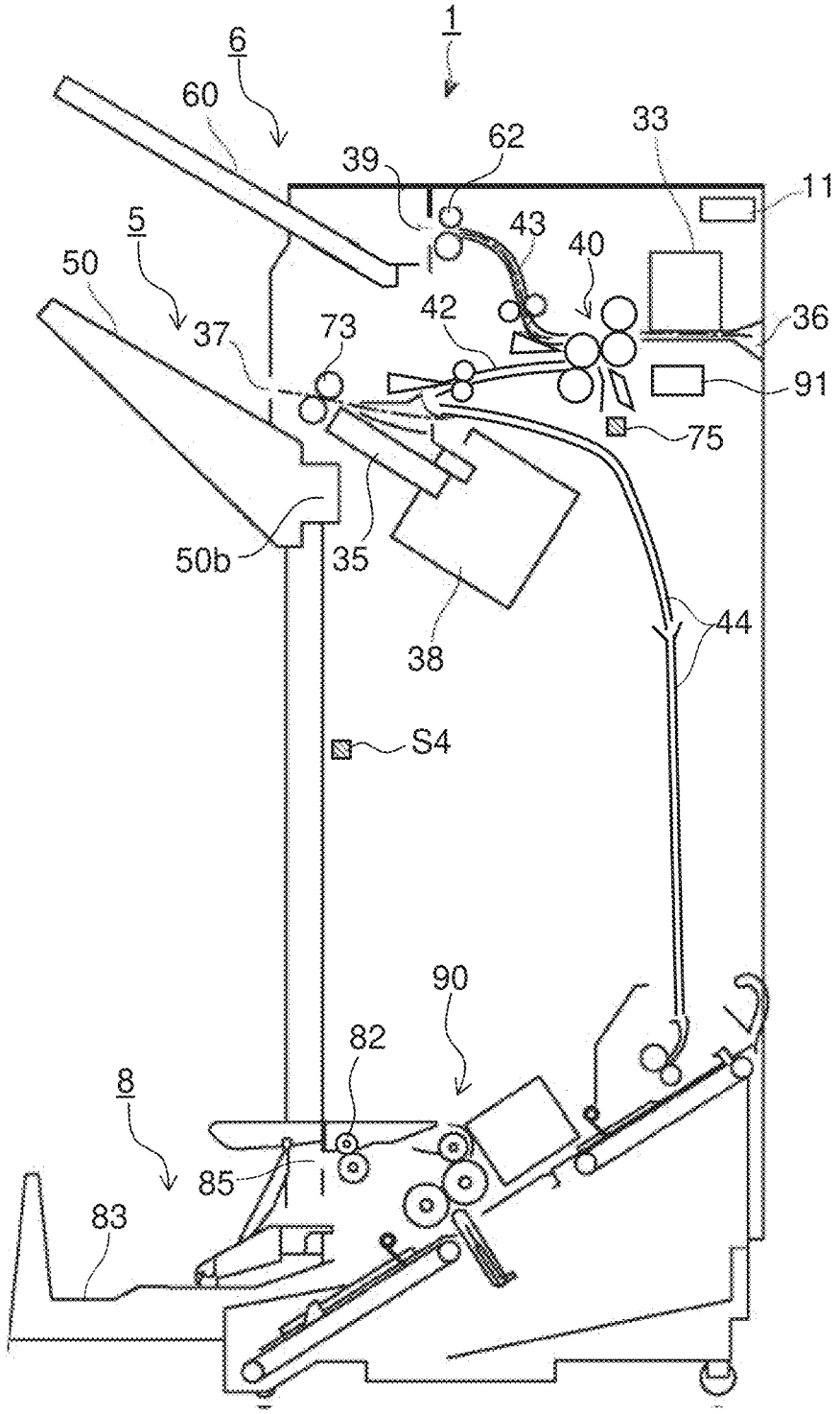
FIG. 2 is a side sectional view showing an internal configuration of the sheet post-processing device.
Figure 3:
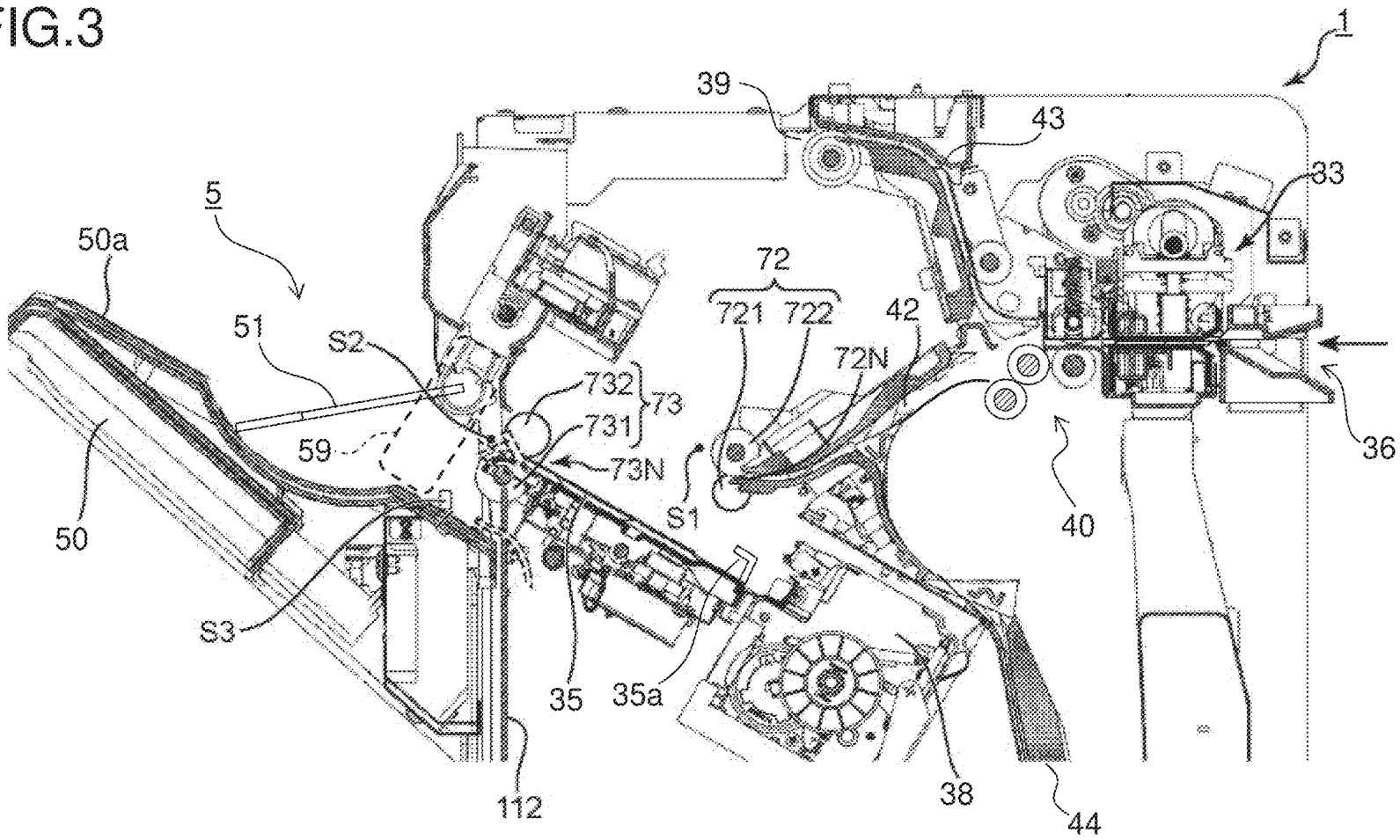
FIG. 3 is partial sectional view of and around a processing tray in FIG. 2.

FIG. 2 is a side sectional view showing an internal configuration of the sheet post-processing device 1 including the first sheet discharge portion 5. FIG. 3 is a partial sectional view showing a structure of and around a processing tray 35 in FIG. 2. As shown in FIGS. 2 and 3, the sheet post-processing device 1 includes a sheet introduction port 36 through which a sheet having been discharged from a discharge portion (not shown) of the image forming apparatus 100 is introduced, a punch hole forming device 33 that performs predetermined punching processing with respect to a sheet having been introduced through the sheet introduction port 36, the processing tray 35 on which a plurality of sheets are stacked, a stapling unit 38 that binds a bundle of sheets stacked on the processing tray 35 with a staple, a first folding unit 40 and a second folding unit 90 that perform folding processing with respect to a sheet, the first sheet discharge portion 5, a second sheet discharge portion 6, a third sheet discharge portion 8, and a post-processing control portion 11 that performs overall control of the sheet post-processing device 1.

The sheet introduction port 36 communicates with a main discharge port 37 through a first conveyance path 42. A second conveyance path 43, which is connected to the first conveyance path 42 so as to branch off from it, communicates with a second discharge port 39. Further, a third conveyance path 44, which is connected to the first conveyance path 42 so as to branch off from it, communicates with a third discharge port 85 via the second folding unit 90.

A sheet introduced through the sheet introduction port 36 is fed out to a downstream side (a left side in FIG. 3) along the first conveyance path 42. In the first conveyance path 42, between its upstream and downstream ends in a sheet conveyance direction, a pair of intermediate rollers 72 are disposed. The pair of intermediate rollers 72 are constituted of a driving roller 721 that rotates by being fed with driving force from a conveyance drive portion (not shown) and a driven roller 722 that rotates by following the driving roller 721. The driving roller 721 and the driven roller 722 are kept in pressure contact with each other under a predetermined nip pressure, and thereby form a conveyance nip portion 72N that nips a sheet to convey it.

Closely downstream of the pair of intermediate rollers 72, a first sheet sensing portion S1 is disposed. The first sheet sensing portion S1 is a sensor that optically senses a sheet, and senses entry of a leading end of a sheet conveyed along the first conveyance path 42 into the pair of intermediate rollers 72. The first sheet sensing portion S1 also senses passing of a trailing end of a sheet conveyed by the pair of intermediate rollers 72 through the pair of intermediate rollers 72.

At a downstream end of the first conveyance path 42, a pair of first discharge rollers 73 (a discharge portion) is provided that feeds out a sheet to a first discharge tray 50. The pair of first discharge rollers 73 are constituted of a driving roller 731 that rotates by being fed with driving force from a discharge drive portion (not shown) and a driven roller 732 that rotates by following the driving roller 731. The driving roller 731 and the driven roller 732 are kept in pressure contact with each other under a predetermined nip pressure, and thereby form a discharge nip portion 73N that nips a sheet to convey it. When a sheet is pulled onto the processing tray 35 for stapling performed by the stapling unit 38, the pair of first discharge rollers 73 move apart to release the discharge nip portion 73N.

Closely downstream of the pair of first discharge rollers 73, a second sheet sensing portion S2 is disposed. The second sheet sensing portion S2 is composed of (though none is illustrated) an actuator having a contact segment with which a sheet discharged by the pair of first discharge rollers 73 makes contact and a sensing segment, and a photosensor having a light-emitting portion and a light-receiving portion that are disposed opposite each other with the sensing segment in between. When the leading end of a sheet conveyed by the pair of intermediate rollers 72 makes contact with the contact segment, the actuator pivots clockwise to cause the sensing segment to be located outside an optical path extending from the light-emitting portion to the light-receiving portion. As a result, the leading end of the sheet is sensed to have entered the pair of first discharge rollers 73 and to be being discharged by the pair of first discharge rollers 73. On the other hand, when the trailing end of a sheet passes across the contact segment, the actuator pivots counter-clockwise to cause the sensing segment to be located in the optical path extending from the light-emitting portion to the light-receiving portion. As a result, the trailing end of the sheet is sensed to have passed through the pair of first discharge rollers 73.

Below the first conveyance path 42, the processing tray 35 is disposed. With the discharge nip portion 73N between the pair of first discharge rollers 73 released, the processing tray 35 receives and stacks sheets conveyed by the pair of intermediate rollers 72. The bundle of sheets stacked on the processing tray 35 is subjected to stapling processing by the stapling unit 38. The processing tray 35 has its downstream end (a left end in FIG. 3) in the sheet conveyance direction located near the pair of first discharge rollers 73, and has its upstream end (a right end in FIG. 3) located under the pair of intermediate rollers 72, so that the processing tray 35 is inclined with a downward slope from its downstream end to its upstream end in the sheet conveyance direction.

The bundle of sheets stacked on the processing tray 35 and having been subjected to the stapling processing by the stapling unit 38 is discharged by the pair of first discharge rollers 73 having the discharge nip portion 73N restored, or by a bundle discharge member 35*a* that reciprocates along a sheet stacking surface of the processing tray 35, to the first sheet discharge portion 5.

The first sheet discharge portion 5 is provided on one side face of the sheet post-processing device 1 that is on the opposite side with respect to the other side face facing the image forming apparatus 100. The first sheet discharge portion 5 is disposed at the downstream end of the first conveyance path 42 with respect to the sheet conveyance direction. The first sheet discharge portion 5 includes the pair of first discharge rollers 73, the first discharge tray 50 that receives a sheet having been discharged by the pair of first discharge rollers 73 through a first discharge port 37, an alignment member 51, and a width regulation member 59.

The first discharge tray 50 is provided on a side face (a left side face in FIG. 2) of the sheet post-processing device 1 so as to be vertically movable. The first discharge tray 50 is one of final discharge destinations of a sheet having been post-processed by the sheet post-processing device 1. To the first discharge tray 50, a sheet that has not been post-processed, a small-size sheet, and the like are also discharged.

Above the first discharge tray 50, a top surface sensor S3 is disposed that senses a position of a top surface of a sheet stacked on a sheet stacking surface 50*a* of the first discharge tray 50. The top surface sensor S3, which is a photo interrupter sensor (PI sensor) having a sensing portion composed of a light-emitting portion and a light-receiving portion disposed respectively at one and the other sides in a sheet width direction, can sense the position of the top surface of a sheet when the optical path of the sensing portion is interrupted by the sheet stacked on the sheet stacking surface 50*a*.

Below the first discharge tray 50, a lower limit sensor S4 (see FIG. 2) is disposed that senses a lower limit position of the first discharge tray 50. The lower limit sensor S4, which is a PI sensor similar to the top surface sensor S3, can sense the first discharge tray 50 having lowered to its lower limit position when an optical path in its sensing portion is interrupted by a flag 50*b* provided on the first discharge tray 50 so as to project therefrom.

Above the first discharge tray 50, a pair of alignment members 51 are provided. The alignment members 51 make contact with a side edge or the top surface of a sheet discharged onto the sheet stacking surface 50*a* of the first discharge tray 50, and thereby not only align the sheet stacked on the sheet stacking surface 50*a* in the width direction but also suppress lift of the sheet. Detailed descriptions will be given later of a configuration and an operation of the alignment members 51.

Upstream of the alignment members 51 with respect to a sheet discharge direction, outward of the alignment members 51 in the sheet width direction, a pair of width regulation members 59 are provided. The width regulation members 59 are movable in the sheet width direction, and align the position of a sheet stacked on the sheet stacking surface 50*a* of the first discharge tray 50 in the sheet width direction by pressing a side edge of the sheet. The alignment members 51 and the width regulation members 59 constitute an alignment mechanism that aligns a sheet stacked on the sheet stacking surface 50*a* of the first discharge tray 50 in the sheet width direction. Detailed descriptions will be given later of a configuration and an operation of the width regulation members 59.

The sheet post-processing device 1 of the present embodiment is capable of, when discharging a plurality of copies of a bundle of sheets to the first sheet discharge portion 5, executing sorting (shifting) processing in which bundles of sheets are sorted by shifting, on a copy-by-copy basis, a discharge position of a sheet alternately to one side and the other side in the sheet width direction. The sorting processing is executed by the post-processing control portion 11 by controlling, (although not shown), a cursor that shifts a bundle of sheets stacked on the processing tray 35 (a shift portion) in the sheet width direction and a cursor drive portion that causes the cursor to reciprocate.

The second sheet discharge portion 6 is provided on one side face of the sheet post-processing device 1 that is on the opposite side with respect to the other side face facing the image forming apparatus 100, above the first sheet discharge portion 5. The second sheet discharge portion 6 includes a second discharge port 39 and a second discharge tray 60 that receives a sheet discharged through the second discharge port 39.

The second discharge port 39 is located, with respect to the sheet conveyance direction, at a downstream end of the second conveyance path 43. At the second discharge port 39, a pair of second discharge rollers 62 are disposed. The second discharge tray 60 is located, with respect to the sheet conveyance direction, downstream of the second discharge port 39. A sheet having been conveyed along the second conveyance path 43 to the second discharge port 39 is then discharged by the pair of second discharge rollers 62 through the second discharge port 39 onto the second discharge tray 60. The second discharge tray 60 is one of the final discharge destinations of a sheet having been post-processed by the sheet post-processing device 1.

The third sheet discharge portion 8 is provided on one side face of the sheet post-processing device 1 that is on the opposite side with respect to the other side face facing the image forming apparatus 100, below the first sheet discharge portion 5 (close to a lower end part of the sheet post-processing device 1). The third sheet discharge portion 8 includes a third discharge port 85, a pair of third discharge rollers 82, and a third discharge tray 83. The third sheet discharge portion 8 discharges a bundle of sheets in a booklet form having been subjected to middle-folding processing and middle-binding processing by the second folding unit 90.

Figure 4:
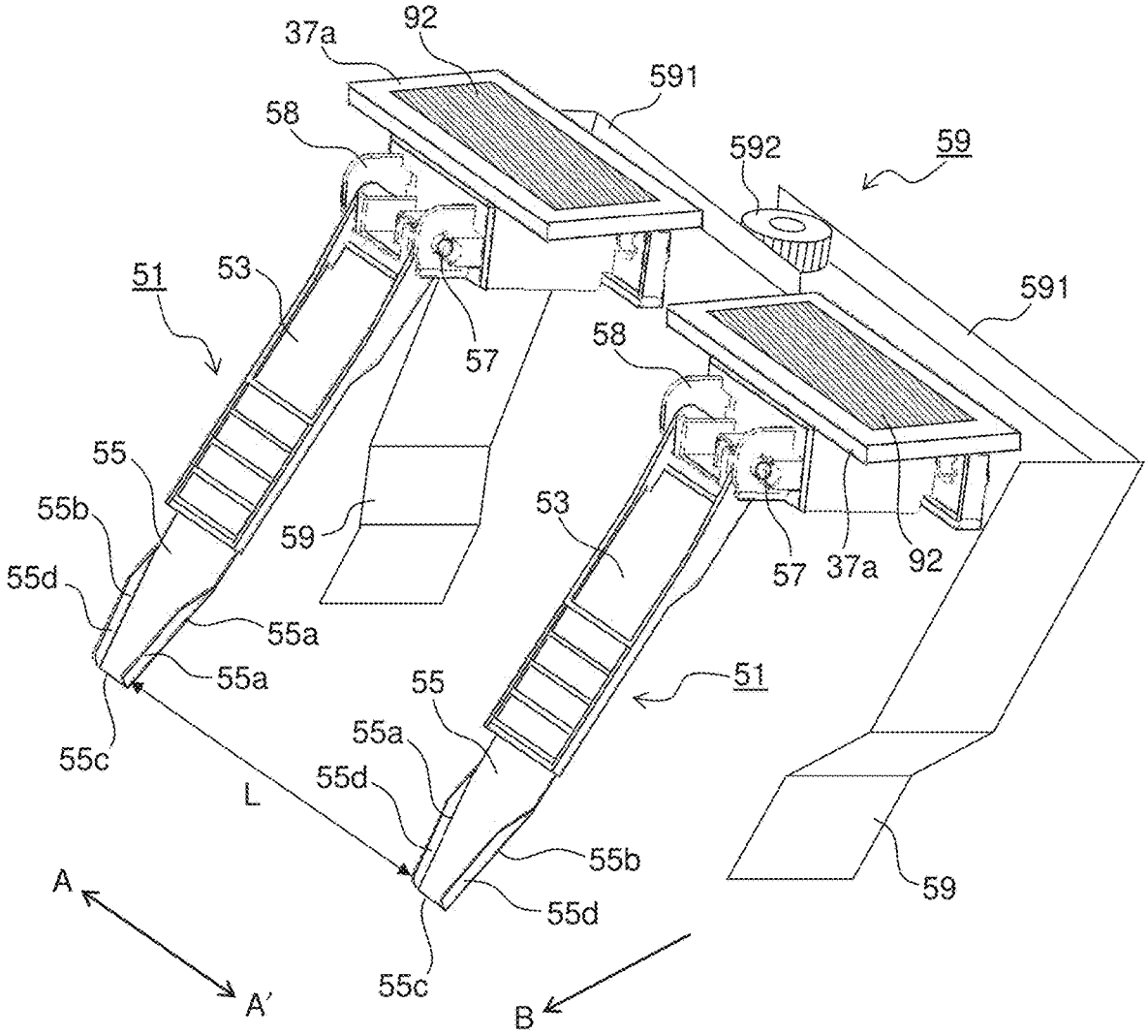
FIG. 4 is a perspective view of alignment members and width regulation members disposed in the first sheet discharge portion.

FIG. 4 is a perspective view of the alignment member 51 and the width regulation member 59 disposed in the first sheet discharge portion 5. As shown in FIG. 4, the alignment member 51 includes the pair of alignment members 51 provided on opposite sides in the sheet width direction (in an arrow AA' direction in FIG. 4). The alignment members 51 include an arm portion 53 and an alignment portion 55.

The arm portion 53 is a plate-shaped member (a rigid body) formed of a synthetic resin or a metal. At an upper end part of the arm portion 53, a pivot shaft 57 is provided that projects in the sheet width direction. The pivot shaft 57 is rotatably engaged with a shaft bearing portion 58 of a holding member 37*a* that is attached to an upper frame (not shown) of the first discharge port 37 (see FIG. 2). With this configuration, the arm portion 53 is supported on the pivot shaft 57 as a swing fulcrum so as to be vertically swingable along the discharge direction.

The alignment portion 55 is fixed to a lower end part (a swingable end) of the arm portion 53, and makes contact with a sheet discharged through the first discharge port 37. The alignment portion 55 is formed of a flat elastic member that extends in the sheet width direction. If the alignment portion 55 causes high friction, it will become a load in discharging a sheet, and thus it is preferable that the alignment portion 55 be formed of a material having a small coefficient of friction. In the present embodiment, a polyethylene terephthalate (PET) film is used as a material of the alignment portion 55.

The alignment portion 55 includes opposite side edges in the sheet width direction, one of which is a first side edge 55*a*, and the other one of which is a second side edge 55*b*, the first side edge 55*a* being located inward of the second side edge 55*b* in the sheet width direction. At a leading end part of the alignment portion 55 (between the first side edge 55*a* and the second side edge 55*b*), a flat portion 55*c* is formed that is parallel to the sheet stacking surface 50*a*. The first side edge 55*a* is inclined from an inner side to an outer side in the sheet width direction toward a downstream side in the discharge direction (an arrow-B direction in FIG. 4). The second side edge 55*b* is inclined from the outer side to the inner side in the sheet width direction toward the downstream side in the discharge direction.

That is, the alignment portion 55 in plan view has a shape of a trapezoid defined by a coupling portion with respect to the arm portion 53 as an upper base, the flat portion 55*c* as a lower base, and the first and second side edges 55*a* and 55*b* as oblique sides (legs). More specifically, the alignment portion 55 has a reversely tapered shape with the coupling portion (the upper base) with respect to the arm portion 53 being longer than the flat portion 55*c* (the lower base).

The first and second side edges 55*a* and 55*b* are each bent upward (in a direction opposite the sheet stacking surface 50*a*), and thereby a pair of bent portions 55*d* are formed.

Figure 5:
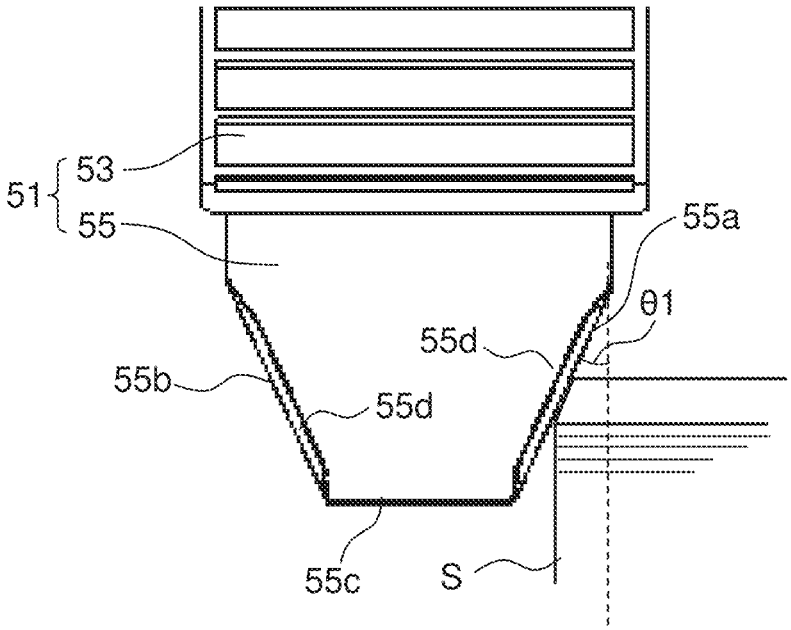
FIG. 5 is a perspective view showing a contact portion between an alignment portion of an alignment member and a sheet.
Figure 6:
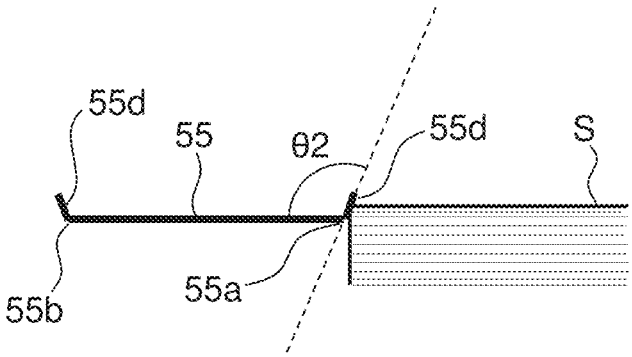
FIG. 6 is a sectional view of the contact portion between the alignment portion of the alignment member and the sheet as seen from a direction of a leading end of the alignment portion.

FIG. 5 is a perspective view showing a contact portion at which the alignment portion 55 of the alignment member 51 makes contact with a sheet S. FIG. 6 is a sectional view of the contact portion at which the alignment portion 55 of the alignment member 51 makes contact with the sheet S as seen from a direction of the leading end of the alignment portion 55. Although FIGS. 5 and 6 show the contact portion at which the alignment member 51 disposed on an apparatus far side (a left and far side in FIG. 4) makes contact with the sheet S, a contact portion at which the other alignment member 51 disposed on an apparatus near side (a right and near side in FIG. 4) makes contact with the sheet S is similar to the one that is shown in FIGS. 5 and 6, except that they are in bilateral symmetry.

In a case where later-described sorting processing is performed, as shown in FIG. a sheet S having been discharged by the pair of first discharge rollers 73 from the first discharge port 37 (for both, see FIG. 3) onto the first discharge tray 50 makes contact with the alignment portion 55 of the alignment member 51 to be aligned and stacked on the sheet stacking surface 50*a*. More specifically, a side edge of the sheet S makes contact with the first side edge 55*a* of the alignment portion 55 of one of the alignment members 51 (here, the alignment member 51 on the left and far side in FIG. 4), and thereby the sheet S is aligned in the sheet width direction.

Here, since the alignment portion 55 with which the sheet S makes contact is formed of an elastic material, it is possible to suppress damage on the side edge of the sheet S. On the other hand, since the arm portion 53 is formed of a rigid body, even when the sheet S discharged is a thick paper sheet or the like having a high stiffness, there is no risk of deformation or vibration of the arm portion 53 caused by being pressed by the sheet S. That is, by forming the arm portion 53, with which the sheet S does not make contact, of a rigid body, and forming only the alignment portion 55, with which the sheet S makes contact, of an elastic material, it is possible to suppress damage and misalignment of the sheet S.

Further, the alignment portion 55 has a reversely tapered shape that is thinner toward its leading end part, and the first side edge 55*a*, which is disposed on the inner side in the sheet width direction, is inclined from the inner side to the outer side in the sheet width direction toward the downstream side in the discharge direction. Thereby, it is possible to securely cause a side edge of the sheet S to make contact with the first side edge 55*a* even in a case where there is a dimensional variation in the sheet width direction among sheets S discharged. Although there is no particular limitation to an inclination angle θ1 of the first side edge 55*a* with respect to the discharge direction, it is preferably about 30°.

Note that, although, in the present embodiment, toward the downstream side in the discharge direction, the first side edge 55*a* of the alignment portion 55 is inclined from the inner side to the outer side while the second side edge 55*b* is inclined from the outer side to the inner side, it is sufficient if at least the first side edge 55*a* is inclined from the inner side to the outer side, and thus the second side edge 55*b* may be parallel to the discharge direction.

Further, by forming the bent portions 55*d* by upwardly bending the first side edge and the second side edge 55*b* of the alignment portion 55, edges of the film constituting the alignment portion 55 is prevented from making contact with the sheet S. This helps suppress damage of the sheet S. Further, as shown in FIG. 6, the alignment portion 55 is bent so as to be sectionally U-shaped, and this gives an appropriate stiffness (elasticity) to the alignment portion 55. Accordingly, it is possible to suppress deformation of the alignment portion 55 caused by being pressed by the sheet S and maintain a good alignment performance. To make the alignment portion 55 unlikely to warp, a bend angle θ2 of the bent portion 55*d* is preferably or an obtuse angle, and is more preferably 90° to 135°.

As shown in FIG. 4, an upper surface of the holding member 37*a* has fixed thereto a magnet member 92 that is sheet-shaped. According to this configuration, by forming the upper frame of the first discharge port 37 of a magnetic body, the holding member 37*a* can be detachably attached to the upper frame of the first discharge port 37 with magnetic force of the magnet member 92. Accordingly, it is possible to adjust a position of the alignment member 51 in accordance with a size of the sheet S discharged through the first discharge port 37. Specifically, the pair of alignment members 51 are disposed such that a maximum interval between the first side edges 55*a* (an interval between the leading end parts) L of the pair of alignment members 51 is narrower than a dimension of the sheet S in its width direction. Further, in a case where the sorting processing, which will be described later, is performed, it is necessary to dispose the pair of alignment members 51 on one and the other side in the sheet width direction, in accordance with a position (a first position R1 and a second position R2 described later) of the sheet S discharged.

Figure 7:
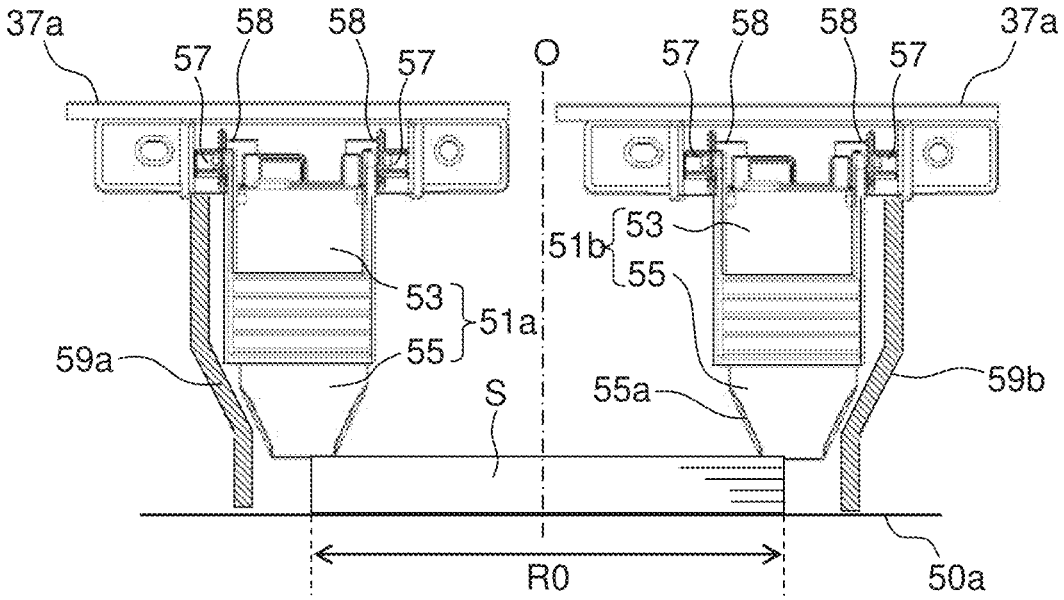
FIG. 7 is a diagram showing a positional relationship of the alignment members and the width regulation members to sheets in a case where the sheets are discharged to a reference position, as seen from a downstream side in a discharge direction.

In the present embodiment, since only sheets S of a same size (e.g., A4 lateral size) are discharged from the first sheet discharge portion 5, the pair of alignment members 51 are fixed at predetermined positions in the sheet width direction. Specifically, as shown in FIG. 7, the pair of alignment members 51 are disposed laterally symmetrically with respect to a widthwise center of a discharge position (a reference position R0) of a case of normal discharge processing (a case where the sorting processing is not performed). Note that, in a case where sheets S of a plurality of different sizes are discharged, the alignment members 51 may be movable in the sheet width direction.

As for a moving mechanism for the alignment members 51, it may be constituted of a moving belt that is endless, to which the holding member 37*a* is attached, and that extends in the sheet width direction, a pulley around which the moving belt is wound, a drive motor that drives the pulley to rotate, etc., for example. Or, it may be constituted of a rack extending in the sheet width direction, a pinion gear provided on the holding member 37*a* to engage with the rack, a drive motor that drives the pinion gear to rotate, etc.

The width regulation member 59 includes a pair of width regulation members 59 provided outward of the alignment members 51 with respect to the sheet width direction. At an upper end part of each of the width regulation members 59, a link portion 591 is provided that is rod-shaped and extends in the sheet width direction. The pair of link portions 59 extending from the width regulation members 59 are opposed to each other in the discharge direction (an arrow B direction in FIG. 4), and each have rack teeth (not shown) formed on an opposed surface thereof.

Between the pair of link portions 591 opposed to each other in the discharge direction, a pinion gear 592 is provided. The pinion gear 592 meshes with the rack teeth formed on each of the link portions 591. By forwardly or reversely rotating the pinion gear 592 by means of a motor (not shown), along with the link portions 591, the width regulation members 59 reciprocate in the sheet width direction.

In a mode in which sheets S are continuously stacked one by one on the first discharge tray 50, the top surface sensor S3 senses the position of the top surface of a bundle of sheets S stacked on the first discharge tray 50. The post-processing control portion 11 performs ascending-descending operation (positioning) of the first discharge tray 50 so as to keep constant the position of the top surface of the bundle of sheets S. Further, the post-processing control portion 11 performs alignment processing of aligning the stacked bundle of sheets S in the sheet width direction by means of the alignment members 51 and the width regulation members 59.

Figure 8:
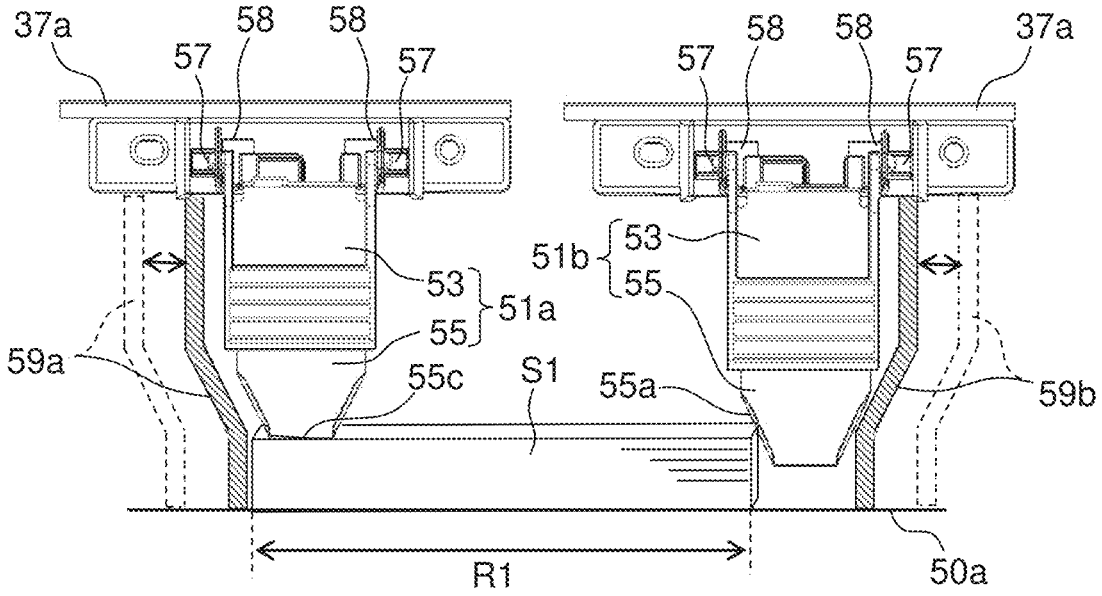
FIG. 8 is a diagram showing a positional relationship of the alignment member and the width regulation member to sheets of a first copy in a case where the sheets are discharged to a first position during sorting processing, as seen from the downstream side in the discharge direction.

Next, a description will be given of the alignment processing performed with respect to sheets S by the alignment members 51 and the width regulation members 59. FIG. 8 is a diagram showing a positional relationship of the alignment members 51 and the width regulation members 59 to sheets 51 of a first copy in a case where the sheets 51 are discharged to the first position R1 during the sorting processing, as seen from the downstream side in the discharge direction. Note that, in the following description, it is assumed that, during the sorting processing, bundles of sheets S are discharged alternately to one side (the apparatus far side, the left side in FIG. 8) and the other side (the apparatus near side, the right side in FIG. 8) in the sheet width direction.

Further, the pair of alignment members 51 and the pair of width regulation members 59 are distinguished by referring to those disposed on the one side (the apparatus far side) in the sheet width direction as a first alignment member 51*a* and a first width regulation member 59*a*, and referring to those disposed on the other side (the apparatus near side) as a second alignment member 51*b* and a second width regulation member 59*b*. The position on the one side and the position on the other side in the sheet width direction to which sheets S are discharged are referred to as the first position R1 and the second position R2, respectively.

When the sorting processing is started, the post-processing control portion 11 first discharges the sheets 51 of the first copy to the one side (the apparatus far side) in the sheet width direction. Thereby, the sheets S1 are stacked at the first position R1 on the sheet stacking surface 50*a* of the first discharge tray 50. At this time, side edges of the sheets 51 on the other side (the apparatus near side) make contact with the first side edge 55*a* (the bent portion 55*d*) of the alignment portion 55 of the second alignment member 51*b*, so that the sheets 51 are aligned at the first position R1. On the other hand, the first alignment member 51*a* is pressed by the sheets S1 to swing to ride on the top surface of the sheets S1. That is, the first position R1 is such a position that the first alignment member 51*a* is located on the top surface of the sheets 51 and the second alignment member 51*b* is outside the sheets 51 in the width direction. And, the first side edge 55*a* of the alignment portion 55 of the second alignment member 51*b* serves as a regulation position for the first position R1.

Further, each time one sheet of the sheets 51 is stacked, the post-processing control portion 11 repeats execution of an alignment operation in which the first width regulation member 59*a* and the second width regulation member 59*b* are moved from their standby positions (positions indicated by broken lines in FIG. 8) to their regulation positions which are inward of their standby positions in the sheet width direction (positions indicated by solid lines in FIG. 8), and then moved again to their standby positions. Thereby, the first width regulation member 59*a* presses the side edges of the sheets S1 on the one side (the apparatus far side) toward the other side (the apparatus near side). As a result, the side edges of the sheet 51 on the other side (the apparatus near side) are pressed against the first side edge 55*a* (the bent portion 55*d*) of the alignment portion 55 of the second alignment member 51*b*. Thus, the sheet S1 is more securely aligned at the first position R1.

Figure 9:
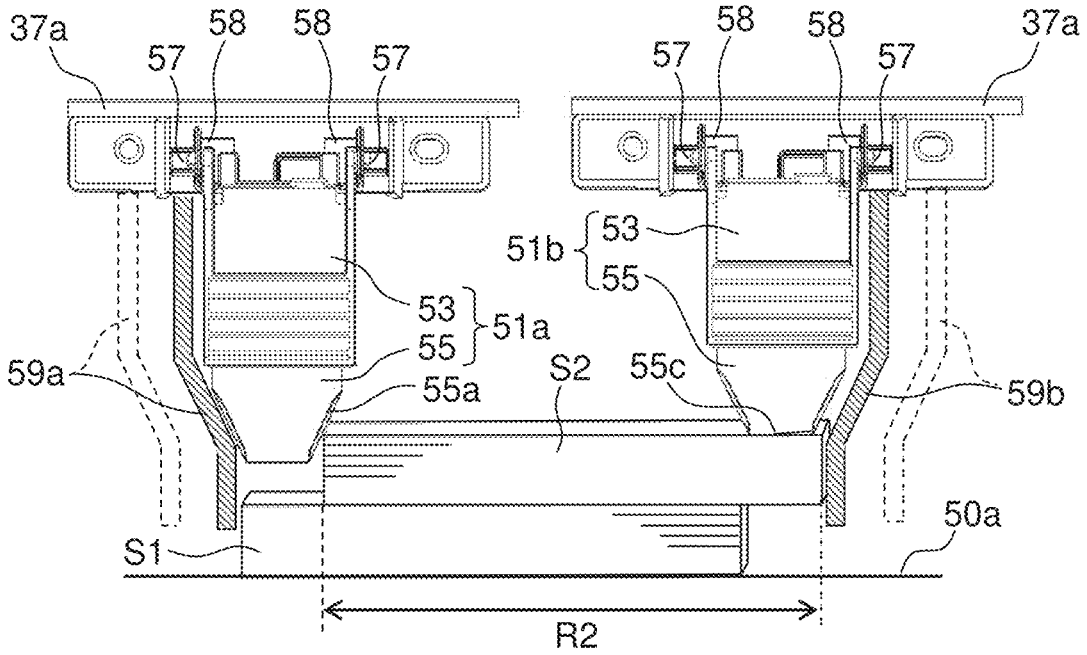
FIG. 9 is a diagram showing a positional relationship of the alignment members and the width regulation members to sheets of a second copy in a case where the sheets are discharged to a second position during the sorting processing, as seen from the downstream side in the discharge direction.

FIG. 9 is a diagram showing a positional relationship of the alignment members 51 and the width regulation members 59 to sheets S2 of a second copy in a case where the sheets S2 are discharged to the second position R2 during the sorting processing, as seen from the downstream side in the discharge direction. On confirming that a predetermined number of the sheets 51 have been discharged, the post-processing control portion 11 proceeds to discharge the sheets S2 of the second copy to the other side (the apparatus near side) in the sheet width direction.

Thereby, at the second position R2 on the sheet stacking surface 50*a* of the first discharge tray 50, the sheets S2 are stacked. At this time, side edges of the sheets S2 on the one side (the apparatus far side) make contact with the bent portion 55*d* formed at the first side edge 55*a* of the alignment portion 55 of the first alignment member 51*a*, so that the sheets S2 are aligned at the second position R2. On the other hand, the second alignment member 51*b* is pressed by the sheets S2 to swing to ride on the top surface of the sheets S2. That is, the second position R2 is such a position that the second alignment member 51*b* is located on the top surface of the sheets S2 and the first alignment member 51*a* is outside the sheets S2 in the width direction. And, the first side edge 55*a* of the alignment portion 55 of the first alignment member 51*a* serves as a regulation position for the second position R2.

Further, each time one sheet of the sheets S2 is stacked, the post-processing control portion 11 repeats execution of the alignment operation by means of the first width regulation member 59*a* and the second width regulation member 59*b* described above. Thereby, the second width regulation member 59*b* presses the side edges of the sheets S2 on the other side (the apparatus near side) toward the one side (the apparatus far side). As a result, the side edges of the sheets S2 on the one side (the apparatus far side) are pressed against the first side edge 55*a* (the bent portion 55*d*) of the alignment portion 55 of the first alignment member 51*a*. Thus, the sheets S2 are more securely aligned in the second position R2.

On confirming that a predetermined number of the sheets S2 have been discharged, the post-processing control portion 11 proceeds to discharge sheets S of a third copy to the first position R1 on the one side (the apparatus far side) in the sheet width direction again. Thereafter, in the same manner, the sorting processing is repeated until a predetermined number of copies of the bundle of sheets S are discharged.

As shown in FIGS. 8 and 9, when the sorting processing is performed, in a case where the stacking position is on the apparatus far side (the first position R1), the alignment processing is performed using the second alignment member 51*b*, and the first alignment member 51*a* is brought into a state of riding on the sheets S1. Further, in a case where the stacking position is on the apparatus near side (the second position R2), the alignment processing is performed using the first alignment member 51*a*, and the second alignment member 51*b* is brought into a state of riding on the sheets S2.

That is, the first alignment member 51*a* and the second alignment member 51*b* function also as sheet pressing members that press a bulge or a curl formed in side edges of the sheets S, and thus it is possible to suppress untidy stacking of the sheets S resulting from one of the sheets S stacked on the sheet stacking surface 50*a* being pushed out by a following one of the sheets S. It is also possible to secure a stacking amount of sheets S on the first discharge tray 50. Further, the discharge position can be switched without needing to move the first alignment member 51*a* and the second alignment member 51*b* in the sheet width direction, and thus there is no need, either, of providing a moving mechanism for the first alignment member 51*a* and the second alignment member 51*b*.

Further, each time one of the sheets S is stacked, the alignment operation is executed by means of the first width regulation member 59*a* and the second width regulation member 59*b*, and this makes it possible to more securely align the stacked state of the sheets S sorted and discharged on the first discharge tray 50.

Note that, when the sorting processing is not performed, all the sheets S are discharged to the reference position R0 (see FIG. 7). And, each time one of the sheets S is stacked, the alignment operation is executed by means of the first width regulation member 59*a* and the second width regulation member 59*b*. Thereby, the sheets S are aligned and stacked at the reference position R0.

It should be understood that the present disclosure is not limited to the above embodiment, and various modifications are possible within the scope of the present disclosure. For example, in the above embodiment, the alignment members 51 and the width regulation members 59 are disposed in the first sheet discharge portion 5, but they may be disposed in the second sheet discharge portion 6 instead.

Further, although the above embodiment has described an example in which the sheet discharge device (the first sheet discharge portion 5) of the present disclosure is applied as a discharge destination of a sheet having been subjected to the post processing by the sheet post-processing device 1, it may be applied as a discharge destination of a sheet having an image formed thereon by the image forming apparatus 100.

Further, although in the present embodiment, a multifunction peripheral as shown in FIG. 1 is dealt with as an example of the image forming apparatus 100, the sheet post-processing apparatus 1 of the present disclosure can be similarly coupled to an image forming apparatus other than a digital multifunction peripheral, such as a laser printer, an inkjet printer, a facsimile machine, or the like.

What is claimed is:

1. A sheet discharge device, comprising:

a discharge portion that discharges a sheet through a sheet discharge port;

a sheet stacking tray on which the sheet discharged through the sheet discharge port is stacked;

an alignment mechanism including:

a pair of alignment members that are disposed on opposite sides in a sheet width direction orthogonal to a discharge direction of the sheet, and that make contact with a top surface of the sheet stacked at a reference position on a sheet stacking surface of the sheet stacking tray; and a pair of width regulation members that are disposed outward of the alignment members with respect to the sheet width direction, and that are reciprocatable in the sheet width direction;

a shift portion that, when the discharge portion discharges a plurality of copies of a bundle of the sheet, shifts a stacking position of the sheet stacked on the sheet stacking tray alternately on a copy-by-copy basis to a first position that is on one side and a second position that is on an other side with respect to the reference position in the sheet width direction; and a control portion that controls the discharge portion, the alignment mechanism, and the shift portion, wherein the pair of alignment members include:

an arm portion that is formed of a rigid body, and that is supported at an upper part of the sheet discharge port so as to be vertically swingable; and an alignment portion that is fixed to a swingable end of the arm portion, and that makes contact with a side edge of the sheet in the sheet width direction, the alignment portion is formed of a flat-shaped elastic material extending in the sheet width direction, and has a first side edge which is such one of a pair of opposite side edges thereof in the sheet width direction as is located inward of an other one of the pair of opposite side edges thereof in the sheet width direction, the first side edge is inclined from an inner side to an outer side in the sheet width direction toward a downstream side in the discharge direction, the control portion is capable of executing, when the discharge portion discharges a plurality of copies of the bundle of the sheet, sorting processing in which the bundle of the sheet is sorted by alternately shifting, on the copy-by-copy basis, between the first position and the second position by means of the shift portion, and in the sorting processing, when stacking the sheet at the first position, the control portion causes a first alignment member of the pair of alignment members that is disposed on the one side to ride on a top surface of the sheet and causes the first side edge of a second alignment member disposed on the other side to make contact with a side edge of the sheet on the other side to align the sheet at the first position, and, when stacking the sheet at the second position, the control portion causes the second alignment member to ride on the top surface of the sheet and causes the first side edge of the first alignment member to make contact with a side edge of the sheet on the one side to align the sheet at the second position.

2. The sheet discharge device according to claim 1, wherein in the alignment portion, the first side edge and the second side edge, which is opposed to the first side edge and disposed outward of the first side edge in the sheet width direction, are each bent in a direction opposite the sheet stacking surface to form a pair of bent portions, and a bend angle of the bent portions is 90° or an obtuse angle.

3. The sheet discharge device according to claim 2, wherein the bend angle of the bent portions is 90° to 135°.

4. The sheet discharge device according to claim 2, wherein in the alignment portion, between the first side edge and the second side edge, a flat portion is formed that is parallel to the sheet stacking surface.

5. The sheet discharge device according to claim 1, further comprising a holding member that swingably holds the arm portion of the pair of alignment members, wherein the holding member has a magnet member fixed to a top surface thereof, and the holding member is attachable and detachable with respect to the upper part of the sheet discharge port formed of a magnetic body.

6. The sheet discharge device according to claim 5, wherein the holding member has a position thereof adjusted in accordance with a size of the sheet discharged through the sheet discharge port such that a maximum interval between the first side edges of the pair of alignment members is narrower than a width-direction dimension of the sheet discharged through the sheet discharge port.

7. The sheet discharge device according to claim 5, wherein in a case where the sorting processing is performed, the holding member has a position thereof adjusted in accordance with a size of the sheet discharged through the sheet discharge port such that the pair of alignment members correspond to the first position and the second position.

8. The sheet discharge device according to claim 1, wherein the control portion, each time one sheet of the sheet is stacked, executes an alignment operation in which the width regulation members are moved from standby positions thereof to regulation positions thereof that are inward of the standby positions thereof in the sheet width direction, and then are moved again to the standby positions thereof, and of the pair of width regulation members, a first width regulation member disposed on the one side moves to the regulation position to press the sheet stacked at the second position toward the other side to press the sheet stacked at the second position against the first side edge of the second alignment member, and a second width regulation member disposed on the other side moves to the regulation position to press the sheet stacked at the first position toward the one side to press the sheet stacked at the first position against the first side edge of the first alignment member.

9. A sheet post-processing device comprising the sheet discharge device according to claim 1.

* * * * *